US007360281B1

(12) United States Patent
MacCartey et al.

(10) Patent No.: US 7,360,281 B1
(45) Date of Patent: Apr. 22, 2008

(54) TIE WRAP WITH INTEGRAL CUTTING DEVICE

(76) Inventors: Edmund Shawn MacCartey, 21-216 Arbor Club Dr., Ponte Vedra Beach, FL (US) 32082; Perry Vaught, 1380 1st St. South, Jacksonville Beach, FL (US) 32250

( * ) Notice: Subject to any disclaimer, the term of this patent is extended or adjusted under 35 U.S.C. 154(b) by 0 days.

(21) Appl. No.: 11/619,175

(22) Filed: Jan. 2, 2007

(51) Int. Cl.
*B65D 63/14* (2006.01)

(52) U.S. Cl. ..... 24/16 PB; 24/30.5 P

(58) Field of Classification Search ..... 24/16 R, 24/16 PB, 30.5 P; 248/74.3; 292/307 A, 292/318, 321, 325
See application file for complete search history.

(56) References Cited

U.S. PATENT DOCUMENTS

| | | | | |
|---|---|---|---|---|
| 69,120 | A | 9/1867 | Paine | |
| 2,936,980 | A | 5/1960 | Rapata | |
| 2,979,794 | A | 4/1961 | DeBartolo | |
| 3,660,869 | A * | 5/1972 | Caveney et al. | 24/16 PB |
| 3,892,011 | A * | 7/1975 | Kohke | 24/16 PB |
| 3,949,449 | A | 4/1976 | Caveney et al. | |
| 4,728,064 | A | 3/1988 | Caveney | |
| 5,088,158 | A | 2/1992 | Burkholder | |
| 5,103,534 | A | 4/1992 | Caveney | |
| 6,332,248 | B1 | 12/2001 | Daniggelis et al. | |
| 6,560,822 | B2 | 5/2003 | Caveney et al. | |
| 6,701,579 | B1 * | 3/2004 | De La Pena Razquin | 24/16 PB |
| 6,704,972 | B2 | 3/2004 | Pyle | |

FOREIGN PATENT DOCUMENTS

| | | |
|---|---|---|
| GB | 137072 | 12/1919 |
| GB | 2402704 | 12/2004 |
| WO | 03023928 | 3/2003 |
| WO | 2005099402 | 10/2005 |

* cited by examiner

*Primary Examiner*—James R. Brittain
(74) *Attorney, Agent, or Firm*—Michael I Kroll

(57) ABSTRACT

A band fastener incorporating a mechanism for selectively severing the band once cinched within the housing. The band is manufactured in a polymeric or elastomeric material having serrations extending therefrom. At one end of the band is a housing with a throughbore for receiving the band free end whereupon the band can be used to cinch one or more articles within the encircling band with the curvilinear face engaging the one or more articles preventing damage thereto. The housing has substantially two parts with one rotative relative to the other. The stationary member receives the band free end, which passes through the rotative member, which incorporates a mechanism for lockingly engaging with the band serrations. The rotative portion of the housing incorporates a pair of cutters. Rotation of the housing rotative member with sufficient torque will sever the band at the cutter location freeing the cinched articles.

12 Claims, 9 Drawing Sheets

TIE WRAP WITH INTEGRAL CUTTING DEVICE

This application claims the benefit of U.S. Provisional Application No. 60/664,583, filed 23 Mar. 2005, which is incorporated herein by reference in its entirety.

BACKGROUND OF THE INVENTION

1. Field of the Invention

The present invention relates generally to ties and, more specifically, to a band fastener incorporating means for selectively severing the band once cinched within the housing. The band is manufactured of a polymeric or elastomeric material having serrations extending therefrom. At one end of the band is a housing with a throughbore for receiving the band free end whereupon said band can be used to cinch one or more articles within said encircling band with the strap or curvilinear face engaging said one or more articles preventing damage thereto.

The housing has substantially two parts with one rotative relative to the other. The stationary member receives the band free end, which passes through the rotative member, which incorporates means for locking engaging with the bad serrations. The rotative portion of the housing incorporates a pair of cutters positioned on opposing bad sides that can be selectively moved into engagement with the band by depressing exterior housing surfaces. Rotation of the housing rotative member with sufficient torque will sever the band at the cutter location freeing the cinched articles.

2. Description of the Prior Art

There are other tie device designed for cinching articles. Typical of these is U.S. Pat. No. 69,120 issued to Paine on Sep. 24, 1867.

Another patent was issued to Rapata on May 17, 1960 as U.S. Pat. No. 2,936,980. Yet another U.S. Pat. No. 2,979,794 was issued to Bartolo on Apr. 18, 1961 and still yet another was issued on Apr. 13, 1976 to Caveney, et al. as U.S. Pat. No. 3,949,449 Apr. 13, 1976.

Another patent was issued to Caveney on Mar. 1, 1988 as U.S. Pat. No. 4,728,064. Yet another U.S. Pat. No. 5,088,158 was issued to Burkholder on Feb. 18, 1992. Another was issued to Caveney on Apr. 14, 1992 as U.S. Pat. No. 5,103,534 and still yet another was issued on Dec. 25, 2001 to Daniggelis as U.S. Pat. No. 6,332,248.

Another patent was issued to Caveney, et al. on May 13, 2003 as U.S. Pat. No. 6,560,822. Yet another U.S. Pat. No. 6,704,972 was issued to Pyle on Mar. 16, 2004. An application was filed by Kendall on Dec. 24, 1918 as U.K. Patent Specification No. 137,072 and still yet another application was published on Mar. 20, 2003 to Salter as International Patent Application No. WO 03/023928. Another was issued to McHale on Dec. 15, 2004 as U.K. Patent Application No. GB2402704 and still yet another application was published on Oct. 27, 2005 to Frank as International Patent Application No. WO2005/099402.

U.S. Pat. No. 69,120

Inventor: Clinton J. Paine

Issued: Sep. 24, 1867

The device of FIG. 1, constructed with the wedge-shaped projection C and wedge-shaped aperture B, substantially as shown, and employed as a tie by using two of such devices inverted and reversed to each other, as explained, in combination with the hoop or band D, as for the purpose specified.

U.S. Pat. No. 2,936,980

Inventor: George M. Rapata

Issued: May 17, 1960

A securing device adapted for retaining an elongated workpiece such as a group of cable-like elements in suspension from a support; said device comprising a generally flat member made of flexible plastic material including an elongated relatively thin and narrow strap portion of rectangular cross-section and a head adjacent one end thereof which is transversely thicker than the body of said strap portion substantially throughout the longitudinal extent thereof, a plurality of locking elements integral with and projecting from one surface of said strap portion and spaced longitudinally therealong, said integral locking elements projecting outwardly from the face of said strap portion a distance substantially as great as the, thickness of said strap portion, each of said locking elements presenting a locking shoulder facing toward the head extremity of the strap portion and a cam surface extending in the opposite direction from the outer extremity of the locking shoulder and toward the adjacent strap surface, said relatively thick head portion having a rectangular aperture therethrough disposed adjacent the area of merger between the head and strap portion and conforming substantially with the rectangular cross-section of said strap portion and adapted to accommodate the free extremity of said strap portion to permit lacing of the strap portion therethrough to form a loop for receiving the aforesaid elongated workpiece with sufficient area of the relatively thick head remaining outwardly of the aperture to receive a fastening element for attachment to a support, said head although thicker than the body of the strap portion being sufficiently resilient to flex as an incident to the forced passage of the locking elements through said rectangular aperture but presenting substantially the thickness of the head material to an inserted locking shoulder whereby to assure firm locking abutment of an inserted locking shoulder against the relatively thick head and resist reverse movement of the strap portion under influence of the weight of the assembly when suspended by the head from a support.

U.S. Pat. No. 2,979,794

Inventor: Francis De Bartolo

Issued: Apr. 18, 1961

A wire or cable bundle tie in the form of a noose slidable one way and selectively clampable against movement the opposite way comprising: a flexible strap having transverse serrations on one face and at one end thereof; and a clamping guide loop with outwardly bowed flexible side walls on the other end thereof, said clamping guide loop being on the same face as said transverse serrations and having a transverse sawtooth tongue depending from the upper inside surface thereof, the vertical portion of said saw-tooth tongue facing the vertical portions of said transverse serrations so that when said one end of said strap is inserted through said guide loop, said vertical portion of said tongue engages the vertical portion of one of said transverse serrations, said flexible side walls of said flexible clamping guide loop being deformable on inward lateral pressure to raise said tongue, thereby releasing said tongue from said serrations to permit removal of said strap from said guide.

U.S. Pat. No. 3,949,449

Inventor: Jack E. Coveney, et al.

Issued: Apr. 13, 1976

An integral one-piece cable tie including an elongated flexible strap having a row of teeth thereon, a frame integral with one end of the strap and having an abutment wall and an end wall and an entry surface and an exit surface and a strap-receiving opening therethrough, a ledge on the end wall extending toward the abutment wall, and a pawl pivotally mounted on and integral with the ledge within the opening end having a set of teeth thereon shaped complementary to the row of teeth.

U.S. Pat. No. 4,728,064

Inventor: Jack E. Caveney

Issued: Mar. 1, 1988

A releasable ladder fastener for securing elongate objects in a bundle having a stud mount boss for securing the ladder fastener to a stud mount. The releasable ladder fastener includes resilient barbed locking members formed at a first end of the ladder strap that releasably engage the side rails of the ladder fastener strap to releasably lock the first end of the ladder strap to the strap of the ladder fastener.

U.S. Pat. No. 5,088,158

Inventor: Gary D. Burkholder

Issued: Feb. 18, 1992

A restraining method employs apparatus that has a body portion and two, laterally-spaced, downwardly extending flexible straps that can be looped around in opposite directions to be lockingly received by a toothed ratcheting mechanism in corresponding laterally-spaced openings of the body portion. An upwardly extending tab has an opening through which a rope can be strung to link together several restrained prisoners. Strap teeth and tab are located in limb noncontacting positions. The straps bend double about self-hinges with free ends fitting within non-ratcheted loops for pocket storage.

U.S. Pat. No. 5,103,534

Inventor: Jack E. Caveney

Issued: Apr. 14, 1992

A selectively coated cable tie is only coated along the lateral edges of the strap of the cable tie leaving an uncoated longitudinally extending medial strip portion of the strap for engagement with a locking mechanism in the head of the tie whereby the selectively coated cable tie provides a cable tie with smooth non-abrasive lateral edges while not significantly degrading the effectiveness of the locking mechanism of the tie.

U.S. Pat. No. 6,332,248

Inventor: Stephen Daniggelis, et al.

Issued: Dec. 25, 2001

A novel wire bundle bounding method that meets the requirements of aerospace specifications is disclosed as well as a novel cable tie used in the method. The method starts with a bundle of wires and the cable tie. The cable tie has a strap body and a locking head with first and second strap passages. The first and second strap passages each have a pawl that locks in the same direction. The strap body is then wrapped around at least one of the wires and then inserted through the first strap passage. Then the strap body is wrapped around the bundle and then inserted through the second strap passage. The strap body is then tightened and the residual strap portion clipped.

U.S. Pat. No. 6,560,822

Inventor: Jack E. Caveney, et al.

Issued: May 13, 2003

A low profile cable tie, preferably a two-piece cable tie, has a low profile locking head with a lateral strap accepting channel and a strap preferably molded with a right angle bend that is retained in this state during non-use. The cable tie has a clean exterior appearance, including a top surface free of openings and a smooth lateral opening. With this cable tie, a strap accepting channel is provided in the locking head that is substantially parallel to a strap attachment axis. The strap accepting channel divides the locking head into a first part, which is secured to the strap, and a second part which contains a locking device. By providing the locking device on the second part, the first part can be made thinner, allowing the strap accepting channel to be closer to the cable bundle being tied. Further, in the case of a two-piece cable tie having a metal locking device, the locking device is preferably bent so as to have a fixed end substantially parallel to the strap accepting channel axis and a free end positioned within the strap accepting channel at an acute angle relative to the strap accepting channel axis. A bottom wall may be shorter in length than an upper wall to define a recessed inset that widens the effective strap accepting channel entrance without increasing the height of the locking head. The inset also allows entrance of the strap over a broader range of entrance angles.

U.S. Pat. No. 6,704,972

Inventor: Kevin J. Pyle

Issued: Mar. 16, 2004

A lightweight plastic bolt-like fastener which is used in pairs having a dual ratcheting function. The fastener includes a bolt having a stem which is semi-cylindrical in cross-section, with a head connected to one end of the stem and a semi-circular aperture in the head positioned coaxially aligned with the stem for receipt of a stem from a second bolt directed in opposite orientation. Positioned longitudinally along the flat side of the stem is a rack of serrated teeth which when the stem is inserted within the semi-circular aperture, a deflectable locking tab attached to the head end of the stem engages the rack of serrated teeth as a ratchet, and since the two fasteners each have stems sliding within the semi-circular aperture of the opposing stem, there is a double ratcheting action between both fasteners.

U.K. Patent Specification Number GB137,072

Inventor: Henry Kendall

Filed: Dec. 24, 1918

The fastener comprises a box or casing 6 having a tapered opening through which passes a wedge 8 having at its smaller end a projection 10 which is only slightly smaller than the opening in the casing. One end of the tie 11 is passed between the wedge and the casing and its end is turned over or other-wise secured to the casing. The other end of the tie is then inserted and the wedge, which is prefer-ably roughened on its underside, is driven in.

International Patent Application Number WO 03/023928

Inventor: James, Salter

Published: Mar. 20, 2003

The endless cable tie fastener device (1) is disclosed. The device is and endless plastic strap (1) to be cut to any desired length with locking assembly (4,5) incorporated into the strap which does not protrude beyond the width of the strap. This enables the off cuts to be re-used and any desired length of cable fastening device (4,5) can be produced in a roll instead of individual single use devises.

U.K. Patent Application Number GB2402704

Inventor: John McHale

Filed: Dec. 15, 2004

A flexible strap, tie or filament 10 received in a fastener element 14 combined with a machine-readable marking or code 18, such as a bar code. The machine-readable marking or code may be carried by a tab or plate 16 formed integrally with the fastener element 14. Otherwise, the machine-readable marking or code may be provided on the flexible filament or strap 10. Two flexible filaments or straps 10 each fixed to a respective fastener element 14 may be used in conjunction to define a loop. This loop may then be used to secure, for example, a neck of a bag passed through the loop, by pulling pull the tabs 16 of the filaments or straps 10 in opposite directions. The filament or strap 10 may comprise ratchet teeth 12 engaged by and eye and pawl element within the fastener element. The strap, tie or filament 10 may be moulded integrally with its respective fastener element 14 and marking-carrying plate 16.

International Patent Application Number WO 2005/099402

Inventor: John R. Frank

Published: Oct. 27, 2005

A one-piece cable tie includes a locking head and an attached strap, the locking head being adapted to receive and selectively engage a portion of the strap when the tie is formed into a closed loop. The cable tie additionally includes an insert fastener formed onto the locking head that is sized and shaped to be retained within a rectangular slot formed in a panel. The insert fastener includes a pair of spaced apart, parallel arms which extend orthogonally away from an outer end wall of the locking head, a cross-member extending transversely across the free ends of the pair of arms and a pair of offset retention fingers. Each retention finger is connected at one end to the cross-member and is capable of being independently pivotally displaced along an arcuate path. As a result of the offset design of its retention fingers, the cable tie can be manufactured as a unitary plastic member using simplified and inexpensive molding techniques.

While these tie fasteners may be suitable for the purposes for which they were designed, they would not be as suitable for the purposes of the present invention, as hereinafter described.

SUMMARY OF THE PRESENT INVENTION

A primary object of the present invention is to provide a band fastener incorporating apparatus for releasing said fastener.

Another object of the present invention is to provide a band fastener manufactured of a polymeric or elastomeric material Yet another object of the present invention is to provide a band fastener having serrations extending therefrom.

Still yet another object of the present invention is to provide a band fastener having a housing with a throughbore fixed at one end of said band.

An additional object of the present invention is to provide said housing with a rotative member for lockingly engaging an inserted band.

Yet another object of the present invention is to provide a band fastener wherein said housing also incorporates cutters positioned over opposing sides of an inserted band.

Still yet another object of the present invention is to provide a band fastener wherein said housing cutters are selectively engaged by depressing housing exterior portions that move the cutters into engagement with the inserted band.

Another object of the present invention is to provide a band fastener that when said cutters are moved into engagement with an inserted band, rotation of the housing rotative member with sufficient torque will sever the band at the cutter location.

Additional objects of the present invention will appear as the description proceeds.

The present invention overcomes the shortcomings of the prior art by providing a band fastener incorporating means for selectively severing the band once cinched within the housing. The band is manufactured in a polymeric or elastomeric material having serrations extending therefrom. At one end of the band is a housing with a throughbore for receiving the band free end whereupon said band can be used to cinch one or more articles within said encircling band with the curvilinear face engaging said one or more articles preventing damage thereto. The housing has substantially two parts with one rotative relative to the other. The stationary member receives the band free end, which passes through the rotative member, which incorporates means for lockingly engaging with the band serrations. The rotative portion of the housing incorporates a pair of cutters positioned on opposing band sides that can be selectively moved into engagement with the band by depressing exterior housing surfaces. Rotation of the housing rotative member with sufficient torque will sever the band at the cutter location freeing the cinched articles.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
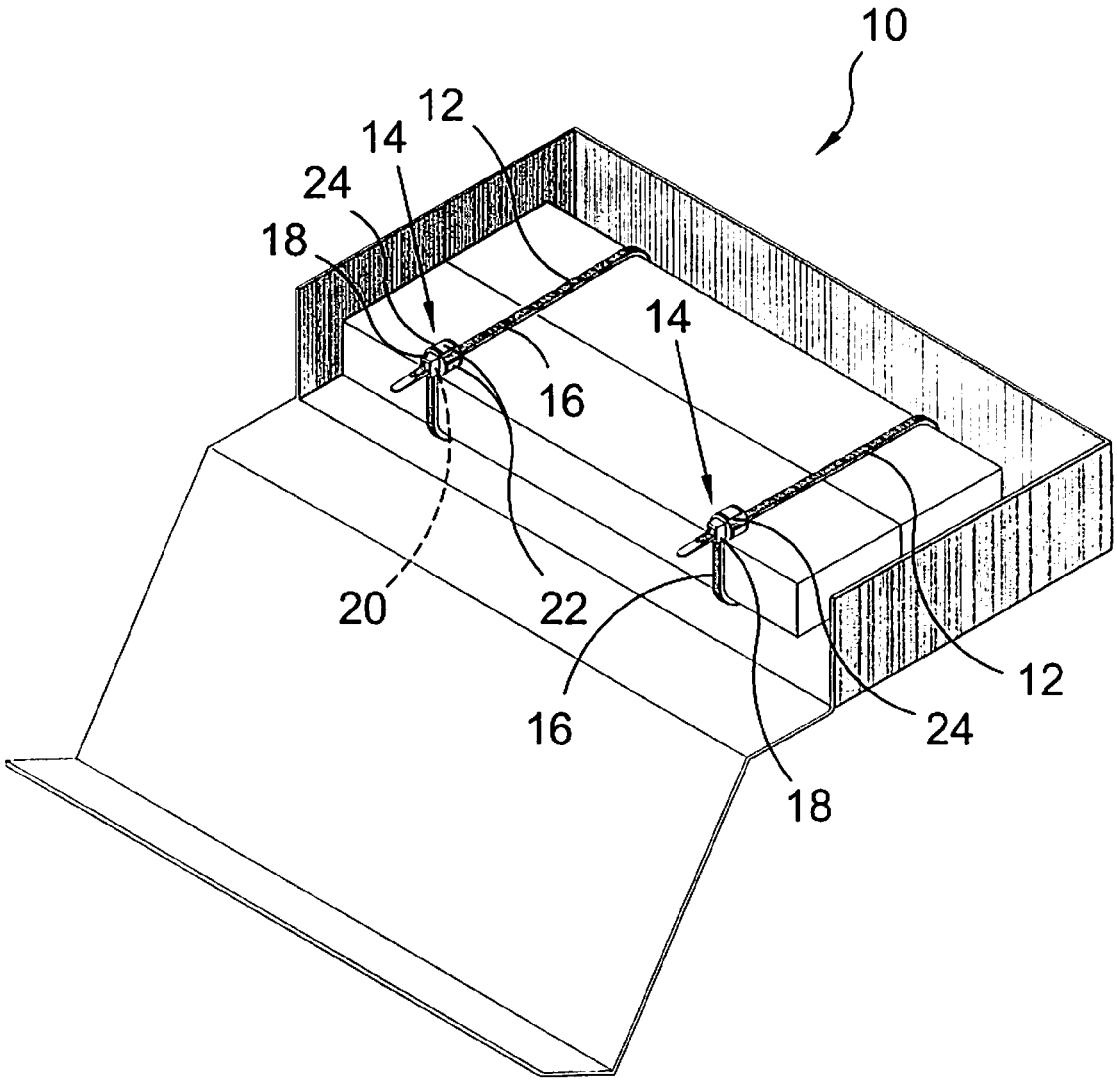
FIG. 1 is an illustrative view of the present invention in us.

Turning now descriptively to the drawings, in which similar reference characters denote similar elements throughout the several views, the figures illustrate the Tie Wrap with Integral Cutting Device of the present invention. With regard to the reference numerals used, the following numbering is used throughout the various drawing figures.

10 Tie Wrap with Integral Cutting Device of the present invention

12 serrated band of 10

14 housing of 10

16 serrations of 12

18 stationary member

20 band lock

22 cutting button

24 swivel member

26 cutting blade

28 band channel

30 color band

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention 10 is a tie wrap comprising a soft durable rubber or plastic flat or round band 12 extending from housing 14 which comprises stationary member 18 and swivel member 24. The stationary member incorporates band lock 20 for securing band 12 therein, while swivel member 24 incorporates means for severing band 12 when desired by the user without having to use any sharp instrument or tool. Cutting buttons 20 are provided and are pressed to move the cutting blades into engagement with band 12, then the swivel member is twisted to make the cut to the band. The device 10 enhances the function of the commonly used twist tie by providing an easy release method.

Figure 2:
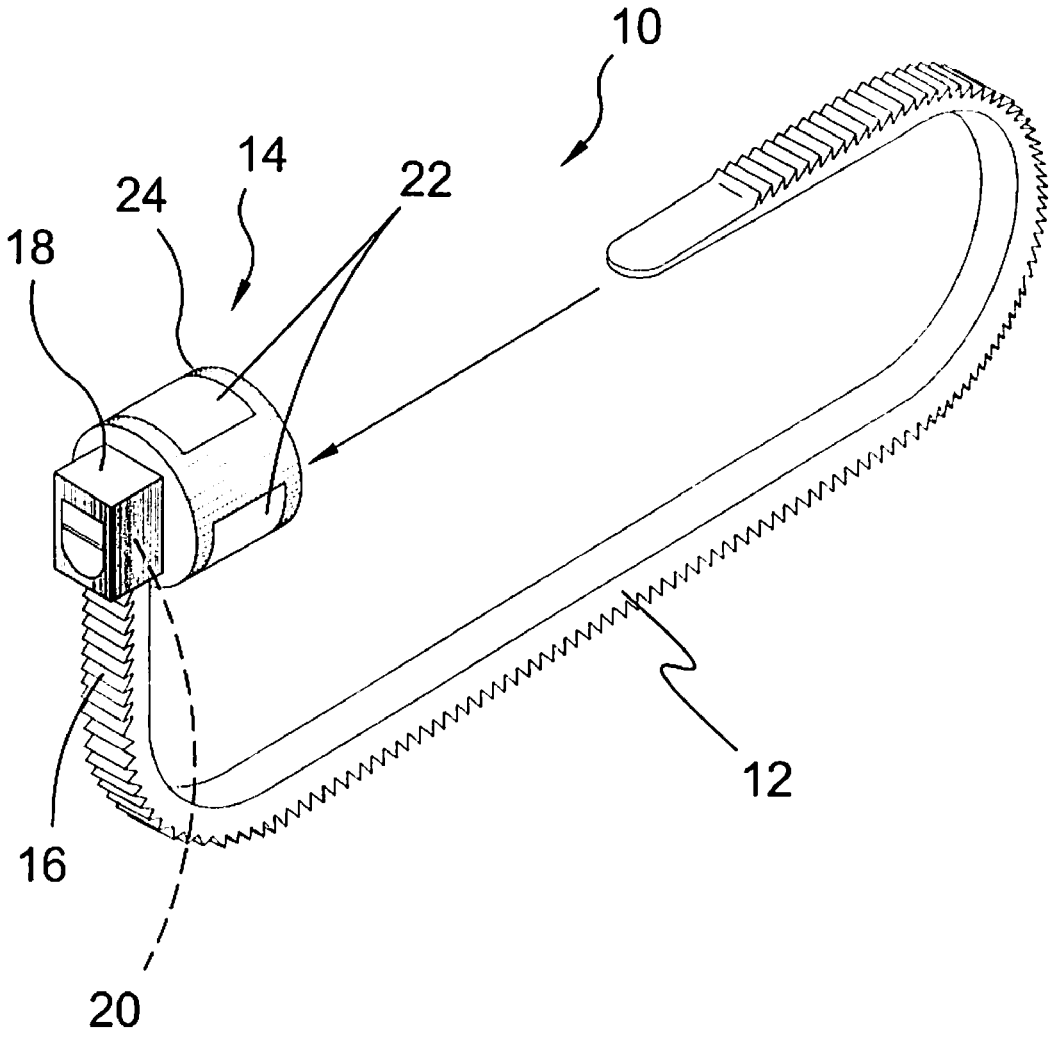
FIG. 2 is a perspective view of the present invention.

FIG. 2 is a perspective view of the present invention 10. The present invention 10 is a band 12 of elastomeric or polymeric material having a band lock 20 for engaging the serrated surface 16 within housing 14 and means for selectively severing the band 12 by depressing a pair of actuatable cutting buttons 22 positioned on opposing sides of the cutting device 24 portion of the housing 14 that move cutters into engagement with the band 12, whereupon rotation of the swivel casing 24 severs the band 12 aft of the band lock 20 freeing the banded article.

Figure 3:
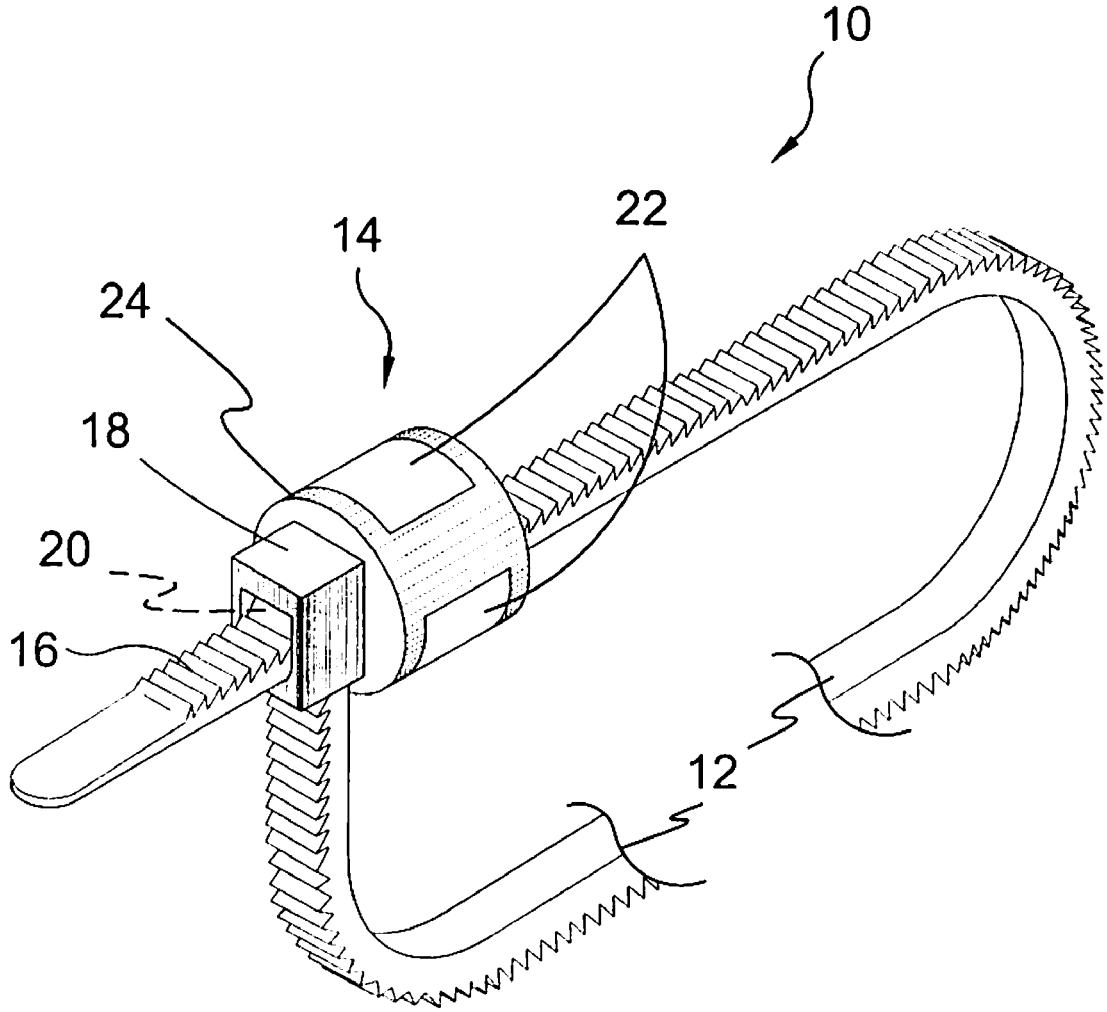
FIG. 3 is a perspective view of the present invention in a locked position.

FIG. 3 is a perspective view of the present invention in a locked position. Shown is the present invention having a band lock 20 for engaging the serrated surface 16 within the housing 14 and means for selectively severing the band 12 by depressing a pair of actuatable cutting buttons 22 positioned on opposing sides of the cutting device within swivel casing 24 portion of the housing 14 that move cutters into engagement with the band 12, whereupon rotation of the swivel casing 24 severs the band 12 aft of the band lock 20 freeing the banded article.

Figure 4:
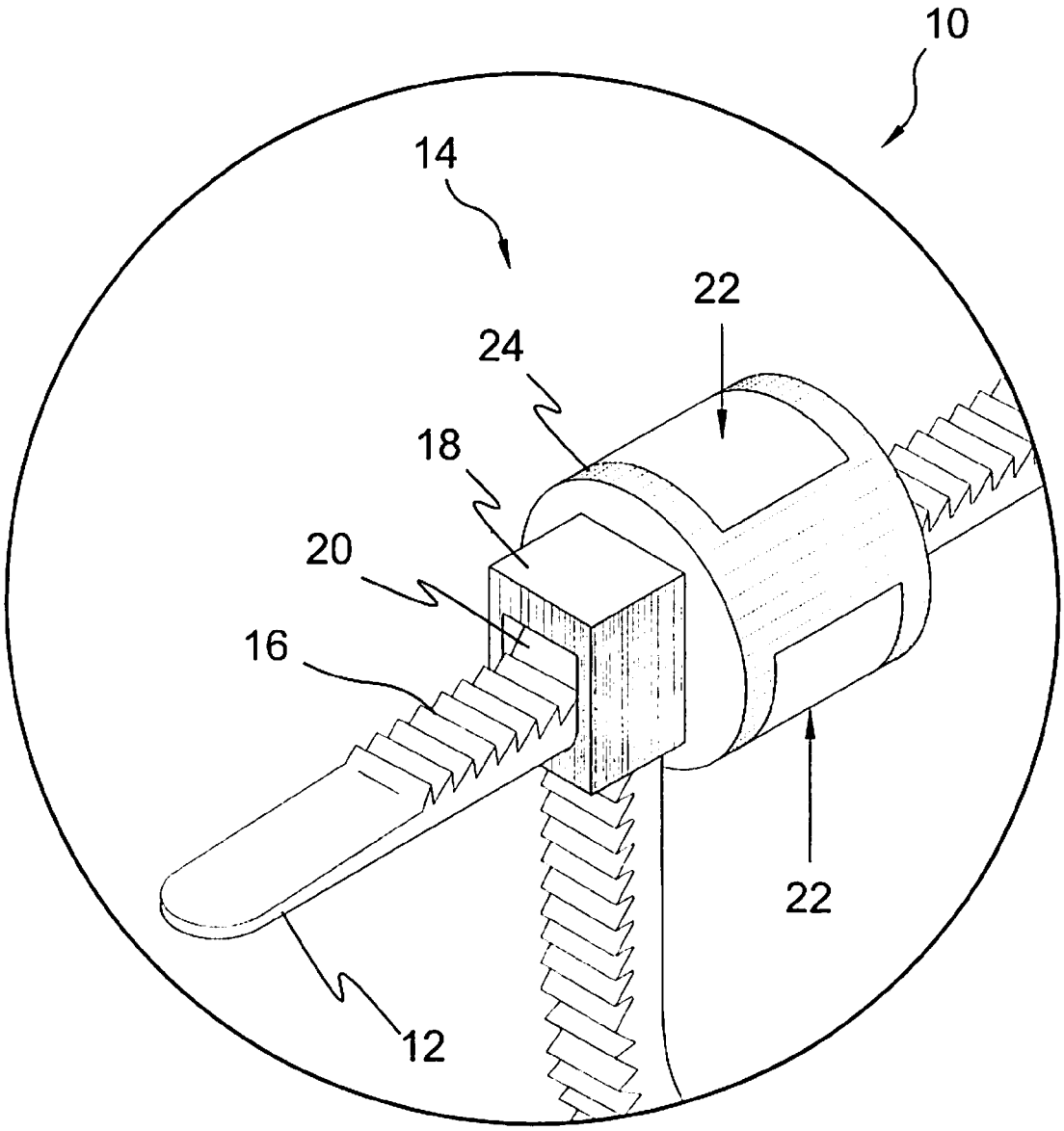
FIG. 4 is an enlarged view of the band in a locked position.

FIG. 4 is an enlarged view of the band 12 in a locked position. The free end of band 12 is inserted into band lock 20 for engaging the serrated surface 16 within housing 14 and means for selectively severing band 12 by depressing a pair of actuatable cutting buttons 22 positioned on opposing sides of the cutting device within the swivel casing 24 portion of housing 14 that move cutters into engagement with the band 12, whereupon rotation of the swivel casing 24 severs the band 12 aft of the band lock 20 freeing the banded article. Rotation of the swivel casing 24 causes the cutters to sever the band 12.

Figure 5:
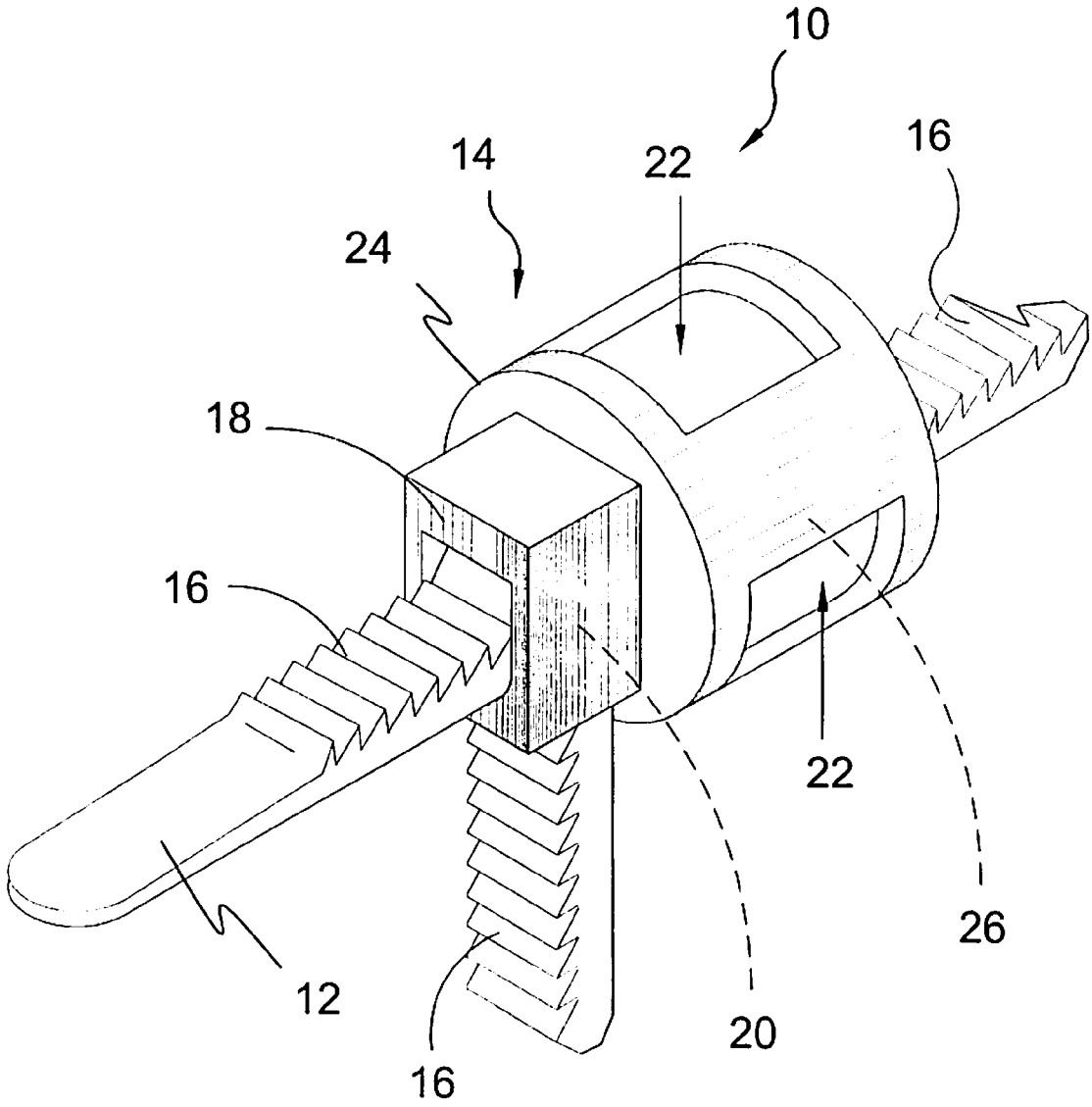
FIG. 5 is an enlarged view of the actuated cutting members.

FIG. 5 is an enlarged view of the actuated cutting buttons 22 of the present invention 10. The cutting buttons 22 of housing 14 are depressed to move the internally disposed cutting members 26 into engagement with band 12. Continuous pressure on the cutting buttons 22 with rotation of the swivel casing 24 severs the band 12 aft of the band lock 20.

Figure 6:
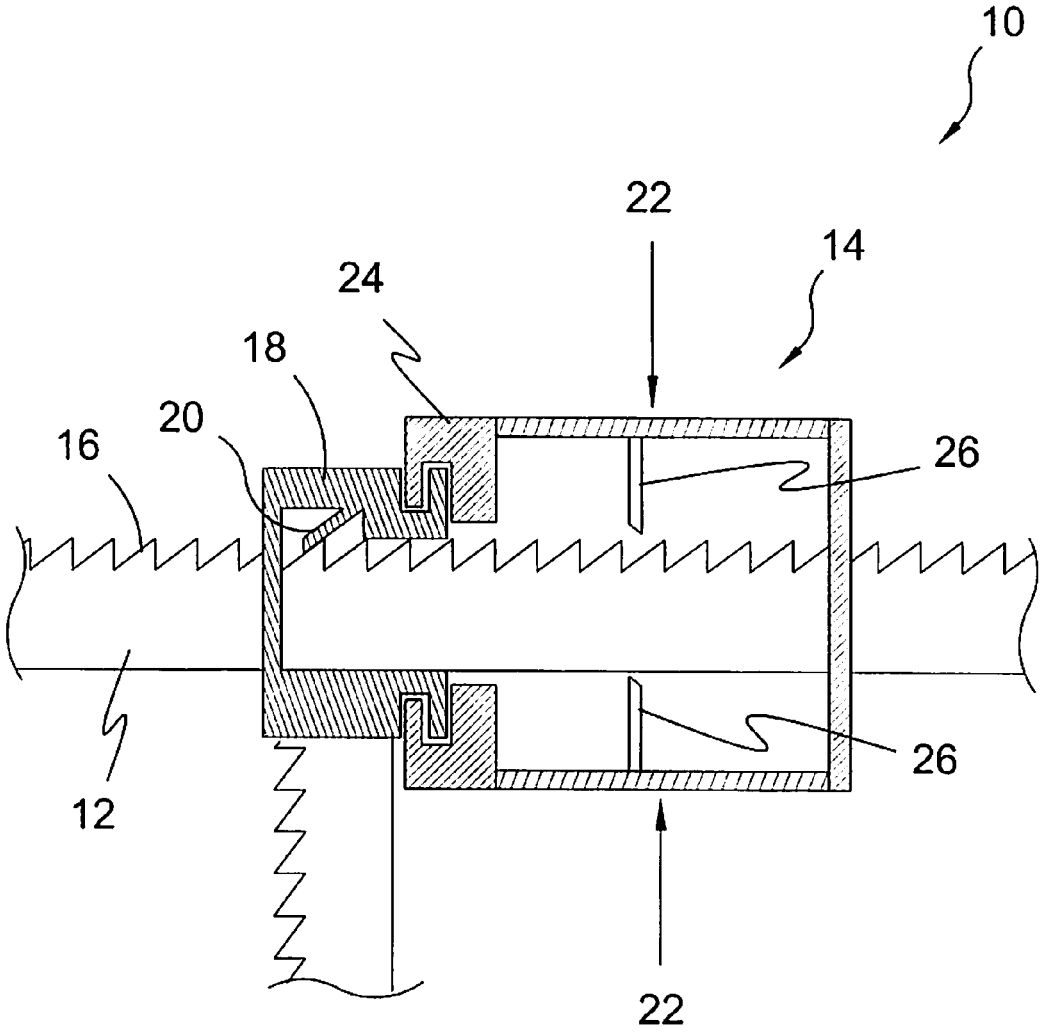
FIG. 6 is a side sectional view of the housing of the present invention.

FIG. 6 is a side sectional view of the housing 14 of the present invention 10. The housing 14 incorporates a band lock 20 for lockingly engaging the band 12 and a cutting device 26 for severing the band 12 releasing the banded articles. The housing 14 is comprised of a stationary portion 18 and a swivel casing 24 rotatable relative to band 12. As the serration 16 passes the locking element 20 band 12 is lockingly engaged with the housing 14. Desirous of releasing the banded article, continuous pressure is applied to the cutting buttons 22 which cause the cutting blades 26 to engage the band 12 before the locking element 20 while rotation of the swivel casing 24 completely severs the band 12 releasing the banded article therefrom.

Figure 7:
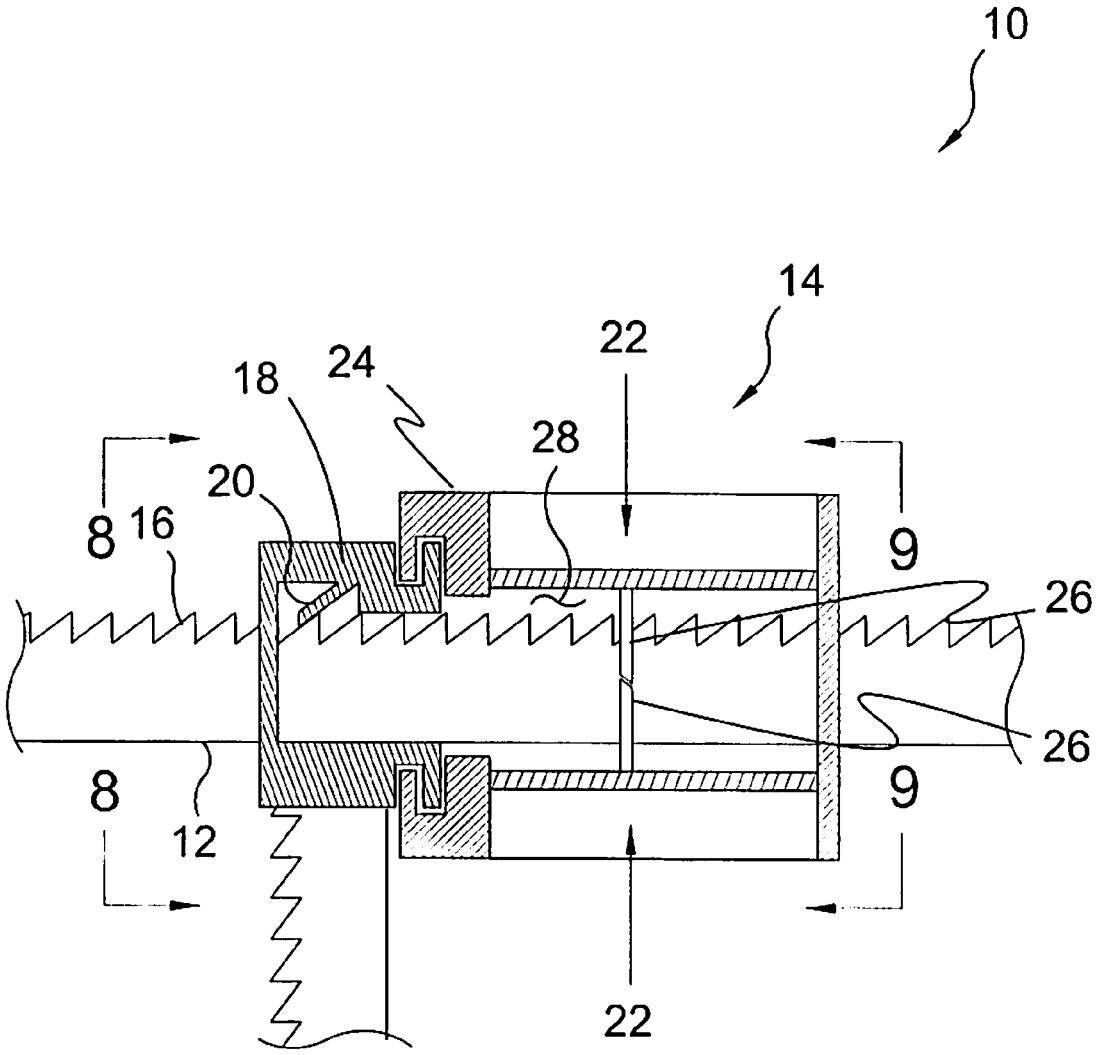
FIG. 7 is a side sectional view of the present invention in a cutting position.

FIG. 7 is a side sectional view of the present invention 10 in a cutting position. The housing 14 incorporates a band lock 20 for lockingly engaging the band 12 and a cutting device 26 for severing band 12 releasing the banded articles. The housing 14 is comprised of a stationary portion 18 and a swivel casing 24 rotatable relative to band 12 and a channel 28 to allow the passage of the band therethrough. As the serration 16 passes the locking element 20 the band 12 is lockingly engaged with the housing 14. Desirous of releasing the banded article, continuous pressure is applied to the cutting buttons 22 which cause the cutting blades 26 to engage the band 12 before the locking element 20 while rotation of the swivel casing 24 completely severs band 12 releasing the banded article therefrom.

Figure 8:
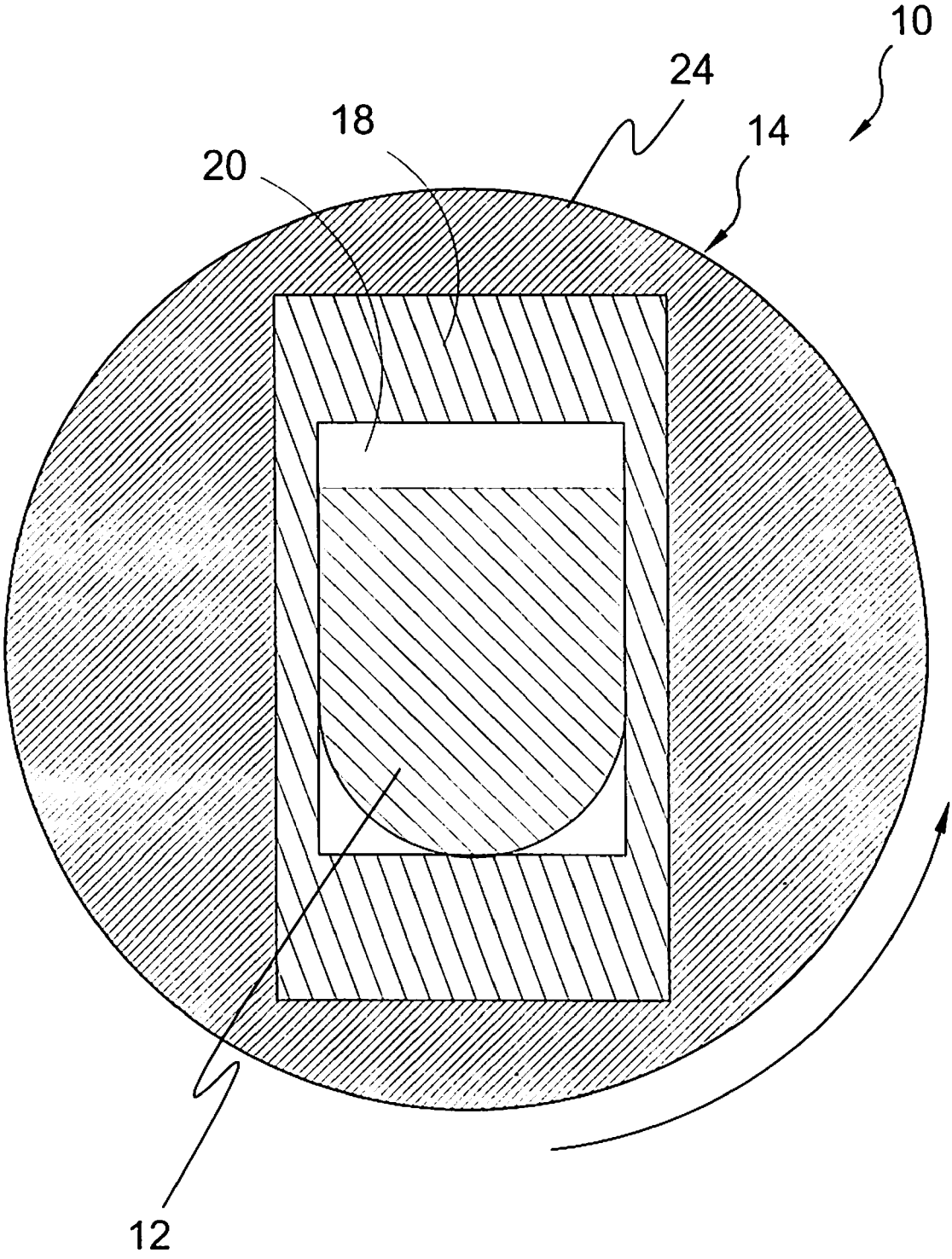
FIG. 8 is a cross sectional view of the present invention.

FIG. 8 is a cross sectional view of the housing 14 of the present invention 10 taken from FIG. 7 as indicated. The present invention 10 is a securing device having a self contained cutting device that allows the user to break the band 12 without having to use any sharp instrument or tool. Cutting buttons are provided and are pressed to activate the cutting blades, then the swivel member 24 is twisted to complete the cut to the band 12.

Figure 9:
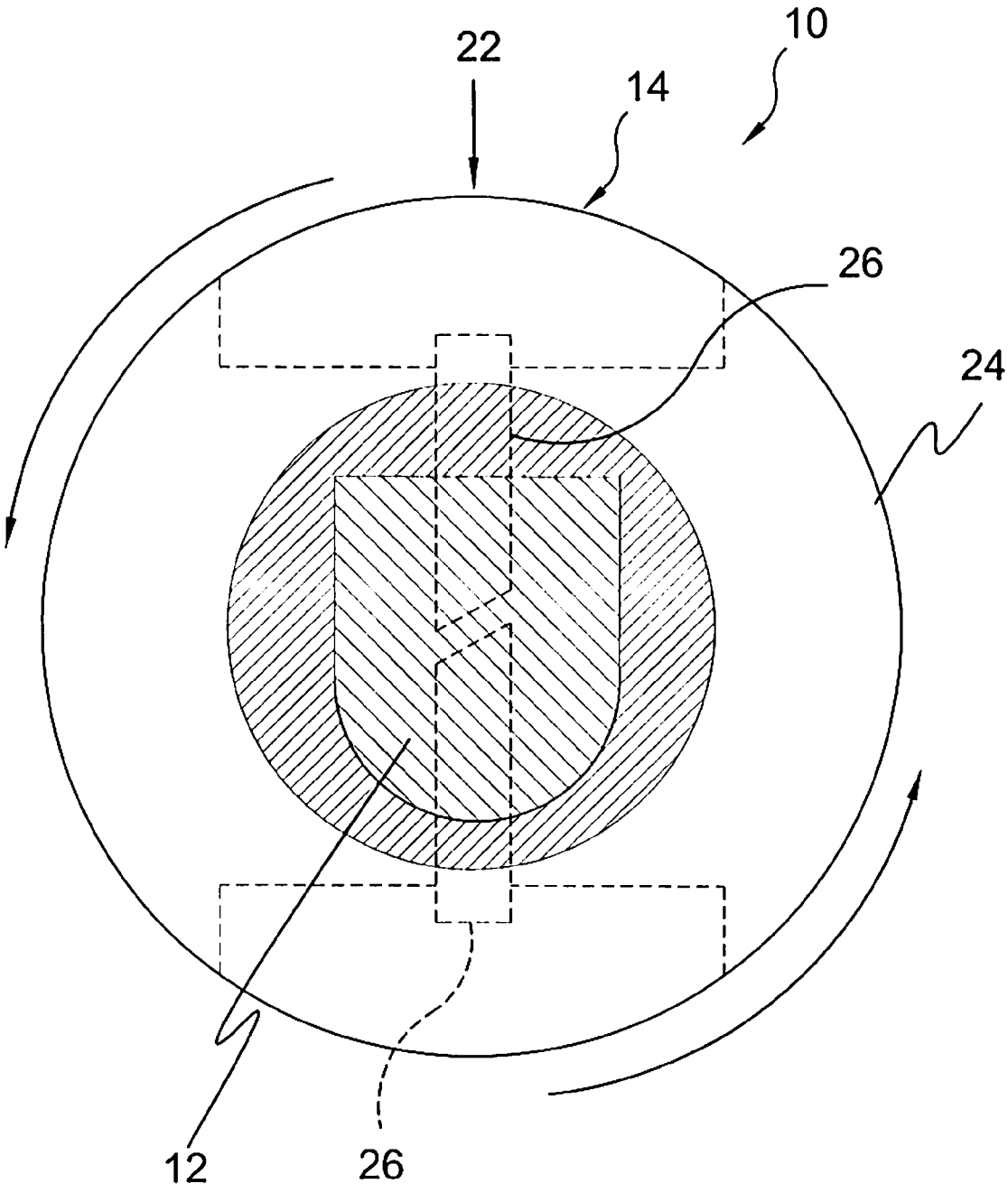
FIG. 9 is a cross sectional view of the present invention.

FIG. 9 is a cross sectional view of the present invention 10 taken from FIG. 7 as indicated. The present invention 10 is a securing device having a self contained cutting device that allows the user to break the band 12 without having to use any sharp instrument or tool. Cutting buttons 22 are provided and are pressed to activate the cutting blades 26, then the swivel member 24 is twisted to make the cut to the band 12.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A tie wrap with integral cutting device comprising:

a) a elongate flexible band having at least one side with angular serrations disposed thereon;

b) a housing comprising;

i) means for securing said band within said housing;

ii) means for cutting said band;

iii) a channel extending through said band cutting means and said band securing means to allow for the passage of said band therethrough;

c) wherein said band securing means is a band lock projecting from the interior portion of said channel, and d) wherein said band cutting means comprises:

i) a stationary interior portion;

ii) a rotative swivel casing encompassing said interior;

iii) a pair of opposing cutting blades with the cutting edges oriented towards said band channel; and iv) means for actuating said cutting blades to encourage said cutting edges to be drawn towards one another.

2. The tie wrap with integral cutting device as recited in claim 1, wherein said band lock is designed to cooperate with said serrations on said band to allow for the one-way travel of said band therein wherein said band can be inserted therethrough but is restricted from backing out.

3. The tie wrap with integral cutting device as recited in claim 2, wherein said band lock is disposed with a substantially similar angle as said serrations thus allowing said band to pass therethrough upon insertion but prohibits the band from backing up.

4. The tie wrap with integral cutting device as recited in claim 1, wherein said actuating means are buttons in communication with said cutting blades that when depressed by the user will urge said cutting blades towards on another.

5. The tie wrap with integral cutting device as recited in claim 4, wherein said cutting buttons are accessed through recesses disposed in said swivel casing corresponding with said cutting buttons.

6. The tie wrap with integral cutting device as recited in claim 5, wherein said band is wrapped around the articles to be fastened together.

7. The tie wrap with integral cutting device as recited in claim 6, wherein the distal end of said band is then inserted into said band channel of said housing and passes therethrough until taut.

8. The tie wrap with integral cutting device as recited in claim 7, wherein said band is retained in a taut state until released by said cutting device.

9. The tie wrap with integral cutting device as recited in claim 8, wherein said cutting buttons are depressed to urge said cutting blades together so as to penetrate said band.

10. The tie wrap with integral cutting device as recited in claim 9, wherein said swivel casing is rotated to rotate the associated cutting blades to fully sever said band and release the secured articles.

11. The tie wrap with integral cutting device as recited in claim 10, wherein the side of said securing band opposite said serrations is flat.

12. The tie wrap with integral cutting device as recited in claim 10, wherein the side of said securing band opposite said serrations is curvilinear.

* * * * *